United States Patent [19]

Kartasuk et al.

[11] 4,040,613

[45] Aug. 9, 1977

[54] VISE CONSTRUCTION

[75] Inventors: Raymond H. Kartasuk, Lincolnwood; Walter R. Smierciak, Elgin; Edward A. Hlinka, Westchester, all of Ill.

[73] Assignee: Wilton Corporation, Schiller Park, Ill.

[21] Appl. No.: 638,650

[22] Filed: Dec. 8, 1975

[51] Int. Cl.[2] ..... B25B 1/10

[52] U.S. Cl. ..... 269/247

[58] Field of Search ..... 269/246, 247

[56] References Cited

U.S. PATENT DOCUMENTS

| | | | |
|---|---|---|---|
| 703,376 | 7/1902 | Bingham | 269/247 |
| 777,611 | 12/1904 | Dodge | 269/246 |
| 3,663,005 | 5/1972 | Peddinghaus | 269/247 |

*Primary Examiner*—Al Lawrence Smith
*Assistant Examiner*—Robert C. Watson
*Attorney, Agent, or Firm*—Olson, Trexler, Wolters, Bushnell & Fosse, Ltd.

[57] ABSTRACT

A vise construction is formed by a fixed body which is to be mounted to a support surface. The fixed body has a slide passage formed therein to receive a guide member or chill bar and a threaded passage is also formed therein to receive the clamping screw. A movable body is mounted to the fixed body and the clamping screw passes therethrough and threadedly engages the threaded passage of the fixed body to effect movement of a pair of gripping jaws formed on the respective bodies toward and away from one another. A recess is formed in the movable body in a location diametrically opposed and in alignment with the slide passage of the fixed body. The chill bar has one edge thereof fashioned to be inserted into the recess and locking means are provided to secure the chill bar and the movable body together as a single unit.

23 Claims, 21 Drawing Figures

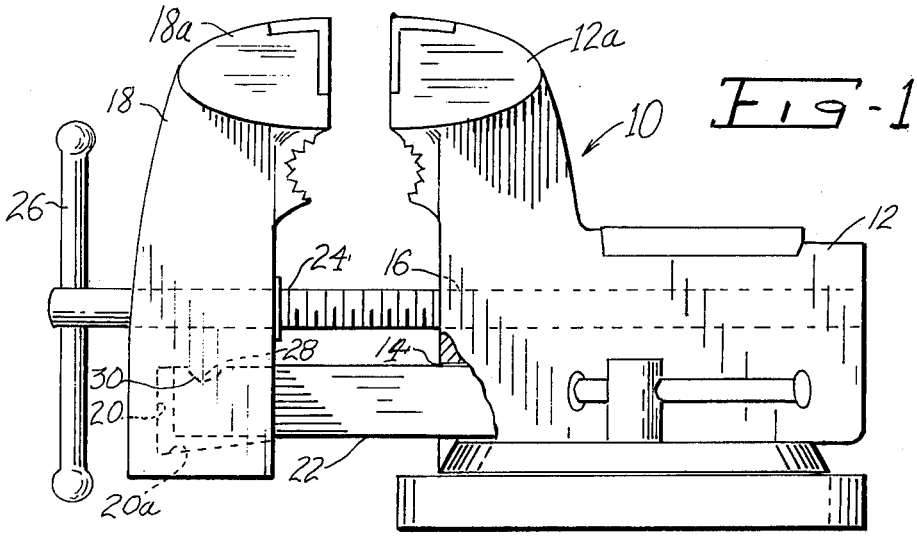
FIG-1
FIG-2
PRIOR ART
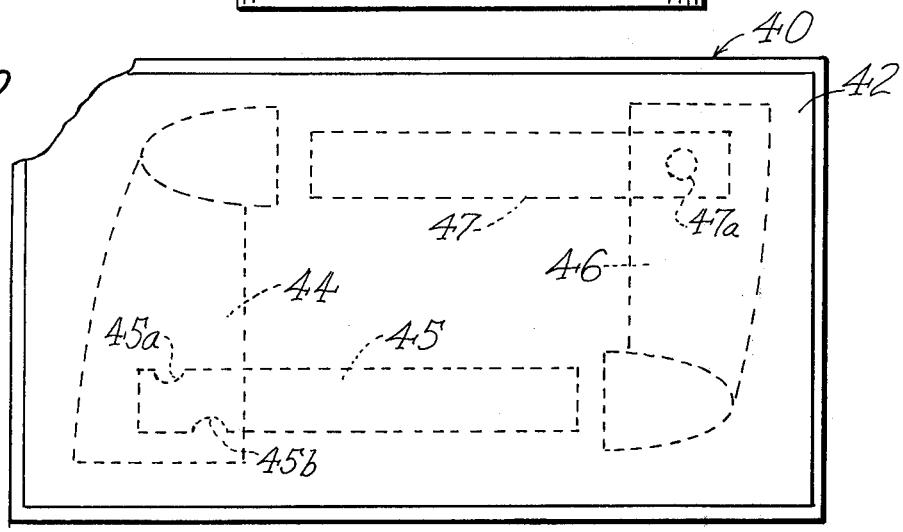
FIG-3
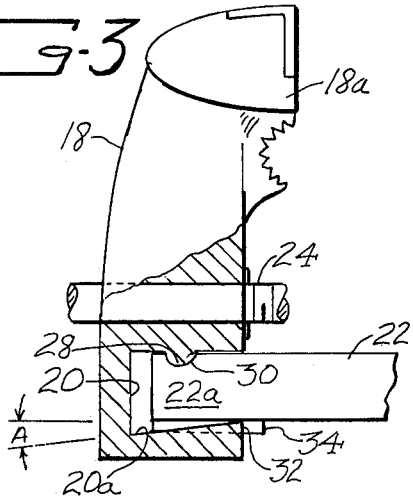
FIG-4
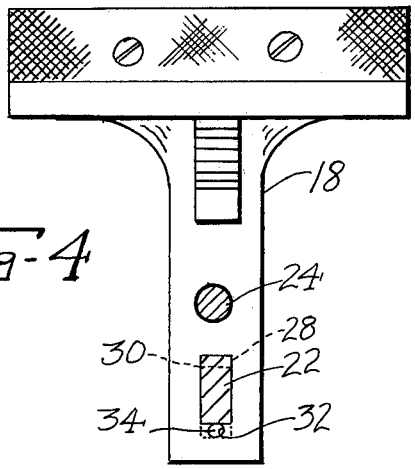

VISE CONSTRUCTION

BACKGROUND OF THE INVENTION

This invention relates generally to a vise construction and more particularly to an improved vise construction and a method of forming the movable head portion and chill bar of a vise as a single unit.

Bench vises for shop or home are well-known in the art for holding various kinds of workpieces in a fixed position to be operated on for a multitude of reasons. Such bench vises generally include a stationary body portion which is securely fastened to a support surface, such as a bench or stand or the like, and a movable body positioned adjacent the fixed body to provide a clamping force. The movable body includes a chill bar formed therewith and extending into a guide passage of the fixed body to provide for linear movment toward and away from the fixed body during operation. Gripping jaws, such as flat narrow surfaces and/or toothed arcuate portions, for holding pipe or the like, are then readily utilized to hold the workpiece securely in position for filing or hammering or the like. Jaw portions of the fixed and movable body components of the vise may include tempered or annealed jaw faces which are fastened to the jaw portions and used to hold either soft or hard materials.

High quality industrial, shop and home use vises generally are of cast iron construction, at least with respect to the stationary and movable components thereof. Such cast iron vises are generally expensive, and as a result have been relatively limited in small shop or home use. One feature of their construction which has increased the cost is the large sand castings required to form the movable head and chill bar assembly. Heretofore, a steel slide bar, commonly referred to as a chill bar or chill, was cut from bar stock of relatively hard steel material. One end of the bar stock is notched, or a hole formed therethrough, to provide a locking recess for the cast material. The chill bar is then placed in a sand mold, at the bottom half thereof, such that the notched end will protrude into the lower end portion of the movable body when molten cast metal is poured into the mold. Upon cooling of the molten cast metal, the chill bar and movable body become a unitary member having high tensile strength as required of large and strong vises. However, because of the need of placing the chill bar in the sand mold to have the end thereof formed in the casting, the cost of forming such vise head portion is relatively high for several reasons. One reason of primary importance is that only a very limited number of movable vise heads can be formed in a single sand mold because of the large amount of space wasted by placing the chill bar within the mold. In many instances, only one vise body and chill bar assembly can be formed in a mold and at best, with the smaller sized units, a pair of movable bodies and chill bars can be formed. The cost of the vise construction is further increased by the fact that a large amount of sand is used to form the mold.

SUMMARY OF THE INVENTION

Accordingly, it is an object of this invention to provide an improved vise construction which is simple and inexpensive to manufacture and efficient and reliable in operation.

Another object of this invention is to provide an improved vise construction which eliminates the need of placing the chill bar into the mold with movable head members during the molding operation.

Another object of this invention is to provide a vise construction of cast iron parts which uses less sand in each mold that forms the parts.

Still another object of this invention is to provide an improved method of fastening the chill bar to the movable body of a vise.

Briefly, the vise construction of this invention is formed of a fixed body for mounting to a support surface and has a slide passage formed in the fixed body slidably to receive a chill bar or other guide means. Also formed in the fixed body is a threaded passage to receive a clamping screw. A first jaw is formed on the fixed body, and a movable body forms a second jaw immediately adjacent the first jaw and movable toward and away from the first jaw upon manipulation of the clamping screw. The movable body is maintained in alignment with the fixed body by the relationship of the guide bar or chill bar passing through the slide passage. The chill bar maintains the proper relationship between the clamping jaws and the clamping screw merely advances and retracts the relationship of the clamping jaws as desired. The movable body is of cast metal and has a preformed recess therein to receive and hold one end of the chill bar. In one embodiment the preformed recess provides a space of predetermined volume and the end of the chill bar which is inserted therein occupies a space within the recess which is less than the predetermined volume. A locking pin or setscrew may pass through an opening in a movable body and engage the inserted end of the chill bar to hold the chill bar in a fixed position such that a nib member will engage a groove formed in a chill bar. The engagement of the nib member of the movable body and groove of the chill bar provides all of the necessary strength for proper operation of the vise. The locking pin or setscrew merely holds the chill bar in proper orientation to maintain engagement of the nib and groove. In place of the locking pin or setscrew, the remaining space of volume within the recess may be filled with epoxy resin which sets into a hardened mass after the nib and recess are engaged one with the other thereby maintaining the relationship.

In another embodiment of the present invention, a restraint bar is permanently attached to the chill bar by welding or the like. A recess conforming to the shape of the restraint bar is also formed in the cast head of the movable jaw. The chill bar is then inserted through the passage of the movable jaw so that the restraint bar engages the recess. An end cap is placed over the chill bar and restraint bar and held in place by a pair of screws which enter threaded holes formed partially within the chill bar and partially within the cast metal forming the movable head. In this embodiment the chill bar can be formed of a hollow tubular structure such as a square tube, round tube or in the alternative, a channel may be used. In all of these configurations the threaded clamping screw passes through the center portion of the chill bar. In this instance the threaded portion receiving the clamping screw is substantially beyond the slide passage through which the chill bar moves. In one embodiment of the hollow tubular chill bar, the clamping screw is provided with an annular flange which fits into a recess formed in the movable head of the vise. The flange is captured by an end cap held in position by three or more screws. The hollow tubular chill bar is locked to the movable head, either by threading the chill bar, when tubular in configuration, and pinning the same or by solely pinning the chill bar to a stationary end cap which fits into a recess formed in the movable head.

Other objects, features and advantages of this invention will be more fully realized and understood from the following detailed description when taken in conjunction with the accompanying drawings where in like reference numerals throughout the various views of the drawings are intended to designate similar elements or components.

BRIEF DESCRIPTION OF THE DRAWINGS

FIG. 1 is a side elevational view of a vise construction utilizing the structural features of this invention;

FIG. 2 is a diagrammatic illustration of a sand casting of the prior art forming movable vise bodies and chill bars as heretofore constructed;

FIG. 3 illustrates a movable vise body and chill bar arrangement according to this invention;

FIG. 4 is a front view of the movable body and the chill bar of FIG. 3;

DETAILED DESCRIPTION OF THE ILLUSTRATED EMBODIMENTS

Figure 5:
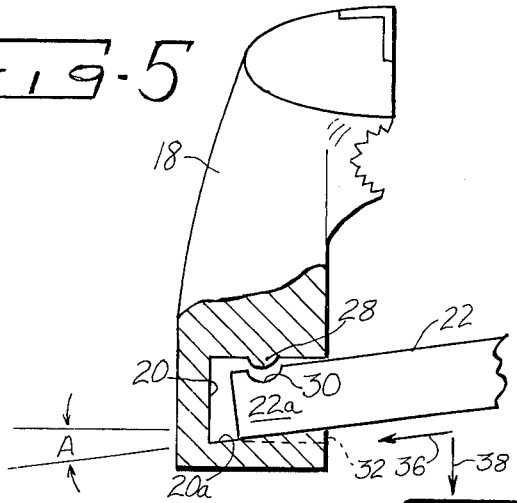
FIG. 5 illustrates the method of constructing the arrangement of the movable body and chill bar in accordance with this invention.

Referring now to FIG. 1 there is seen a vise constructed in accordance with the principles of this invention and is designated generally by reference numeral 10. The vise 10 includes a fixed body 12 to be mounted on any suitable work surface such as a workbench or the like. A slide passage 14 is formed in the fixed body and a threaded passage 16 is also formed in the fixed body and displaced therein upwardly from the slide passage. This portion of the vise structure may be formed by any suitable well-known method heretofore incorporated.

A movable body portion 18 is positioned adjacent the fixed body 12 and is provided with a recess 20 formed therein. The recess 20 is formed in the movable body when the unit is initially cast. A chill bar 22, or other guide bar means, has the end 22a thereof inserted into the recess to be securely fastened to the movable body and form a unitary structure therewith. Also passing through the movable body is a clamping screw 24 freely rotatable therein but further engaging the fixed body 12 for moving a pair of jaw members 12a and 18a toward and away from one another during operation of the vise. The clamping screw 24 is provided with a slidable handle 26 which is well-known in the art and which can extend fully to one or the other end thereof to maintain the maximum leverage of the handle so that maximum gripping action of the clamping jaws **12*a* and 14*a*** can be obtained.

Most advantageously, the recess 20 is provided with nib means 28 formed therein, this nib means preferably being formed during the casting of the movable body 18. The nib means 28 engages a groove 30 formed in the end **22*a* of the chill bar 22 and together therewith provide means for absorbing the structural forces which are created during a clamping operation of the vise. All clamping forces of the vise are exerted through the nib 28 and groove 30. The recess 20 is sized and fashioned to provide a space of predetermined volume, and the end 22*a* of the chill bar 22** is inserted into the recess to an extent which will occupy a volume less than the predetermined volume of the recess.

Referring particularly to FIGS. 3, 4 and 5, the recess 20 is shown having an inclined wall **20*a* which diverges from the horizontal at an angle A. The chill bar 22 is inserted into the recess 20, along the direction of the arrowed line 36, this being substantially along the inclined surface 20*a*, to clear the depending nib member 28. When the chill bar is inserted a sufficient distance, it is pivoted downwardly as indicated by the arrowed line 38 to bring the groove 30 into engagement with the nib 28. Once in this position, a locking pin 34 is inserted through a pin slot 32 at the front end of the movable body 18. The locking pin 34 merely maintains the chill bar in its position so that the nib 28 and groove 30** are at all times engaged.

Referring now to FIG. 2, a prior art method of forming a movable body or vise jaw and chill bar is illustrated. This is shown to provide a better understanding of the present invention. Here a moldbox 40 is filled with molding sand 42 and the broken lines illustrate the movable jaw members 44 and 46 being formed therein. The chill bars 45 and 47 associated with the jaws 44 and 46, respectively, are inserted into the moldbox 40 prior to pouring the molten metal into the mold cavity. Because of the need of a parting line along the symmetrical axis of the movable jaw members 44 and 46, substantial amounts of sand must be used in filling the moldbox to form the mold cavity.

Figure 6:
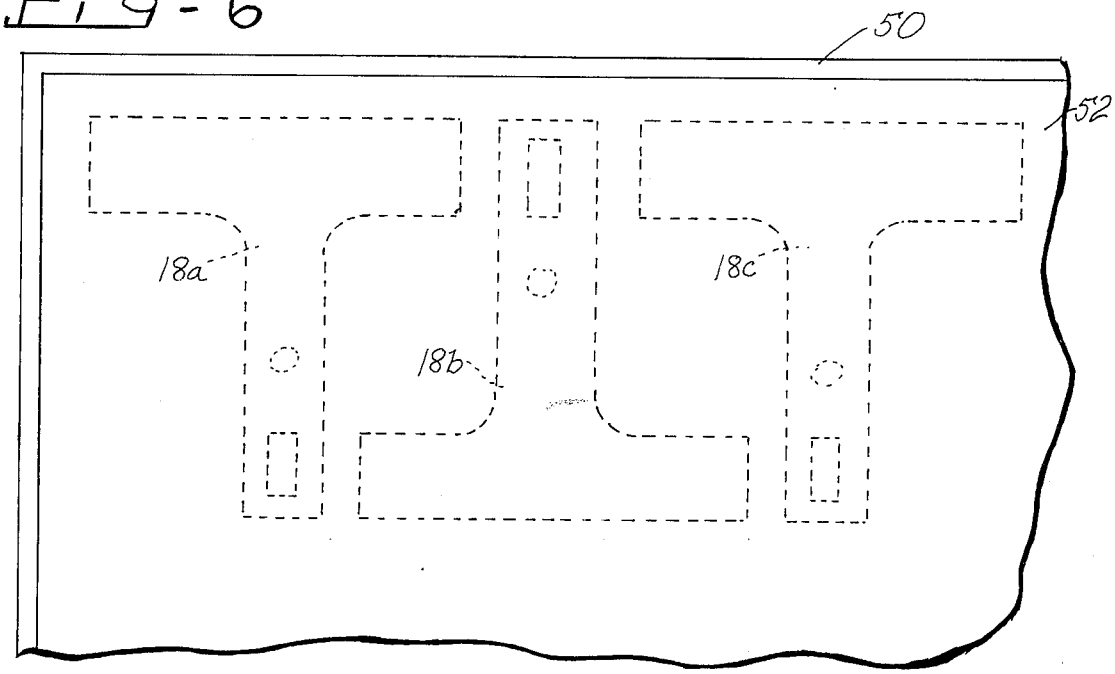
FIG. 6 is a partial view of a sand casting showing a plurality of movable bodies to be cast without the chill bar as an integral part thereof during the casting operation.

In accordance with the method of this invention, however, the moldbox and sand can be more efficiently utilized because the attaching of the chill bar to the movable body 18 is accomplished after the molding operation. For example, referring to FIG. 6, there is illustrated a plurality of movable jaw members 18*a*, 18*b* and 18*c*, it being understood that any number of jaw members can be formed. The moldbox 50 has optimum use of sand 52 which fills the box to form the mold cavities because, among other things, the movable bodies 18*a*, and 18*b* and 18*c* can be orientated in an interleaved manner as shown. Although pouring holes are not illustrated either in FIGS. 2 or 6, it will be understood that any suitable aperture can be formed in the top sand form to receive molten metal.

Figure 7:
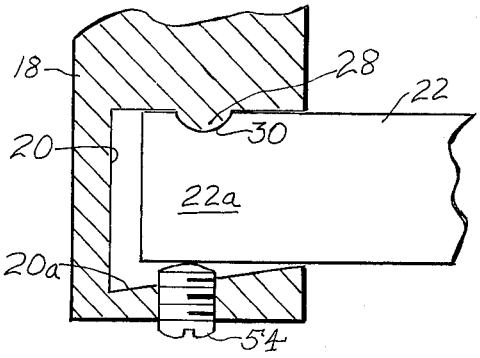
FIG. 7 is an alternate locking means for holding the chill bar in position in the movable body.

Referring now to FIG. 7, an alternate form of holding the chill bar 22 into a locked position so that nib 28 and recess 30 are at all times engaged is shown. Here a setscrew 54 is threadedly inserted through the bottom portion of the movable member 18 to hold the chill bar 22 in the position shown. However, it will be understood that the setscrew 54 may take any suitable position or configuration to achieve the desired results. That is, the setscrew 54 can threadedly pass through the back wall of the movable member 18 and engage a recess formed in the chill bar to prevent it from pivoting downwardly and disengaging the nib 28.

Figure 8:
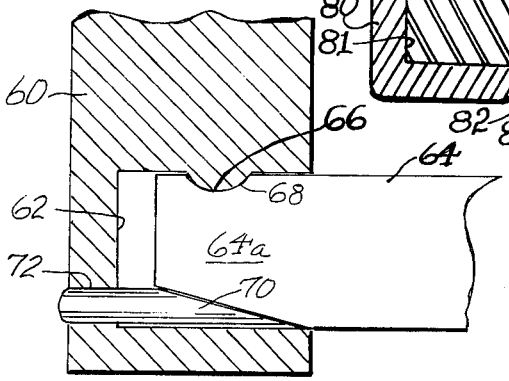
FIG. 8 is another alternate locking means of holding the chill bar in the movable body in accordance with this invention.
Figure 8A:
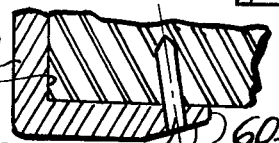

FIG. 8 illustrates still another form of this invention and shows a portion of a movable member 60, similar to the movable member 18, having a recess 62 formed therein to receive the end 64*a* of a chill bar 65. In this instance, the recess 62 is substantially rectangular in configuration thus having no slanted wall associated therewith. The nib 66 depends from the upper wall surface thereof and engages a groove 68 in substantially the same manner as described hereinabove. However, in this instance, the chill bar 64 is maintained in its engaged position by a slanted pin 70 which passes through an aperture 72 in the rear wall of the movable body 60. The chill bar 64 has a slanted end which allows the bar to be pivoted during insertion as mentioned above.

Figure 9:
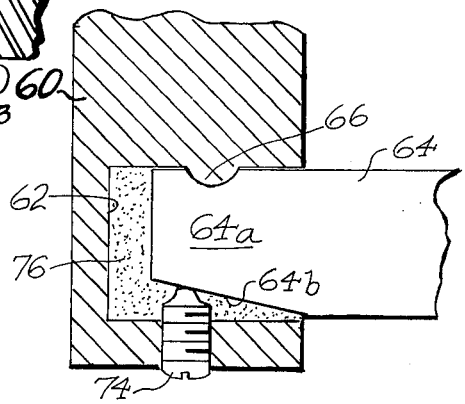
FIG. 9 illustrates still another alternate locking means of holding the chill bar in position in accordance with this invention.

FIG. 9 illustrates still another alternate form of this invention, it showing two different embodiments in the single figure. For example, the combination of FIG. 7 and FIG. 8 may be incorporated to have a setscrew 74 passing through the lower wall of the movable body 60 and engaging the slanted surface 64*b* of the chill bar 64. FIG. 9 also illustrates a quantity of epoxy resin 76 filling the remaining space of the recess 62 such that, when the epoxy hardens, it will prevent disengagement of the chill bar from the nib 66. This epoxy resin can be inserted into the recess through the opening which receives the setscrew 74.

Figure 10:
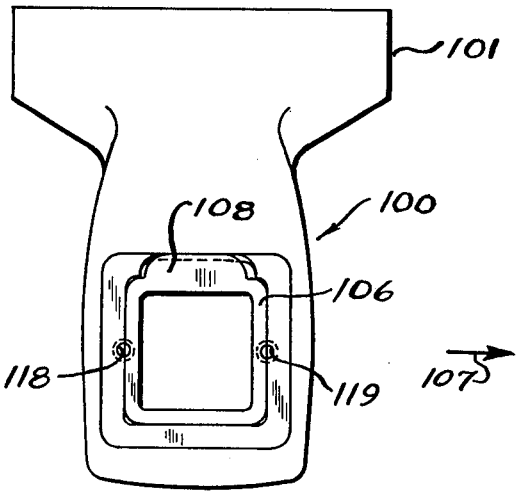
FIG. 10 is an end view of an alternate form of vise constructed in accordance with the principles of this invention.
Figure 11:
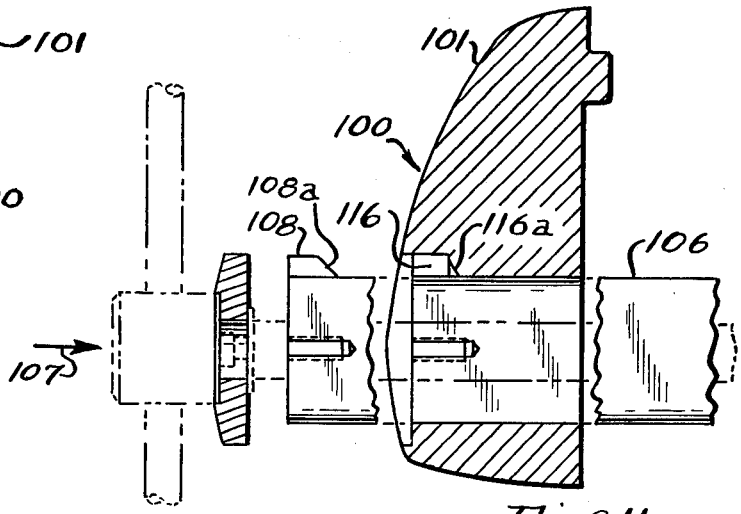
FIG. 11 is a side sectional view of the vise construction of FIG. 10 shown in a preassembled condition.
Figure 12:
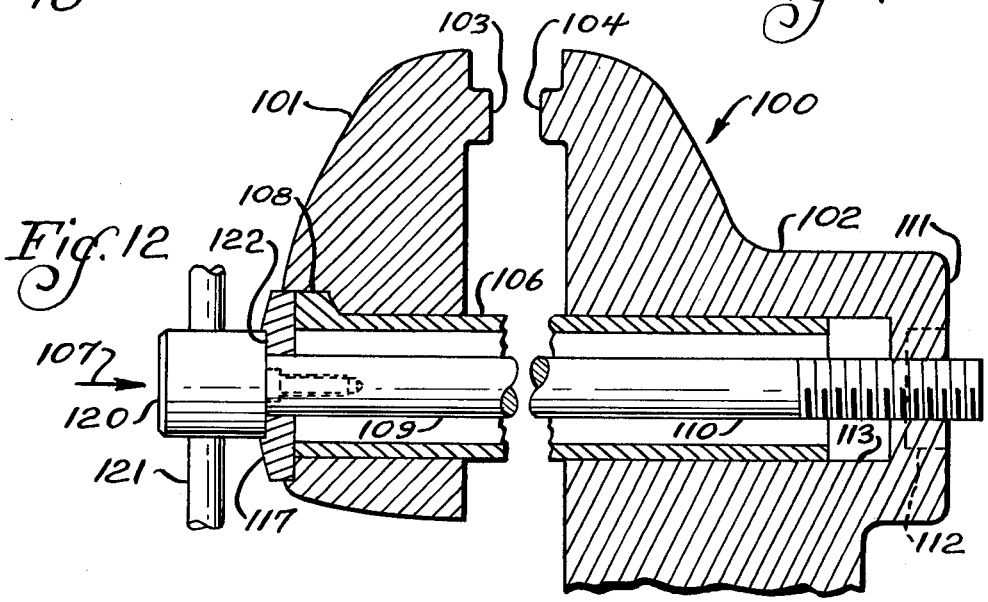
FIG. 12 is a side sectional view of the vise construction of this invention shown in an assembled condition.

Referring now to FIGS. 10, 11 and 12 there is seen still another alternate form of a vise constructed in accordance with the principles of this invention and is designated generally by reference numeral 100. Here the vise 100 has a movable body portion 101 and a fixed body portion 102. Associated with each of the body portions are jaw surfaces 103 and 104, respectively, which open and close away from and toward one another for receiving and clampingly holding a workpiece in place. In this embodiment the movable body portion 101 has a chill bar 106 passing through the movable body from the side opposite the jaw surface 103. This is indicated by the arrowed line 107 in FIGS. 11 and 12.

The chill bar 106 is provided with a restraint bar 108 which may be secured to the chill bar by such means as welding or the like. However, it will be understood that the restraint bar 108 may be formed by, for example, forging, casting, or the like.

Most advantageously, in the configuration illustrated in FIGS. 10, 11, 12, 12 and 14, a clamping screw 109 passes substantially centrally of the chill bar and has a threaded end portion 110 engaging a formed thread or captured threaded nut located at the end 111 of he fixed body portion 102. In the case where a captured threaded nut is used, phantom lines 112 illustrate the relative positioning of the threaded nut within the casting. The outer peripheral configuration of the threaded nut may be square or hexagon, or any other desired configuration.

The fixed body portion 102 has a slide passage 113 through which the guide bar 106 traverses during opening and closing of the movable jaw member 101. Preferably, the dimensions of the slide passage 113 are such to insure easy sliding motion of the guide bar 106.

In accordance with the principles of this invention the clamping screw 109 is substantially completely concealed from view and, therefore, almost no dirt or shaving particles interfere with the threaded portion 110 and the threads or thread nut 112. This type of vise construction, therefore, provides substantial increase in the usable life of the vise. The restraint bar 108 is fashioned to fit into a recess 116 formed in the movable body portion 101 and has a slanted wall surface 108*a* engageable with a slanted wall surface 116*a* to provide a good friction fit of the chill bar within the movable body member. To insure that the chill bar will not inadvertently be dislocated from the movable body portion 101, an end cap 117 is secured to the outer surface of the movable body portion, at the side thereof opposite the clamping surface 103, and is held in place by a pair of threaded bolts or screws 118 and 119. Most advantageously, the threaded portion formed within the vise structure to receive the threaded bolts has half the thread segment formed in the peripheral portion of the movable body 101 which receives the guide bar and the other half of the threads formed in the guide bar, as best seen in FIG. 10.

A spindle portion 120 extends from the clamping screw 109 and has a handle 121 extending transversely thereof, as seen in FIGS. 11 and 12, and which handle portion may be slidable within the spindle, as is well-known in the art. A recess 122 is formed in the cap 117 to provide a relatively smooth bering surface for the spindle and cap and to provide a more uniform appearance to the vise structure.

Figure 13:
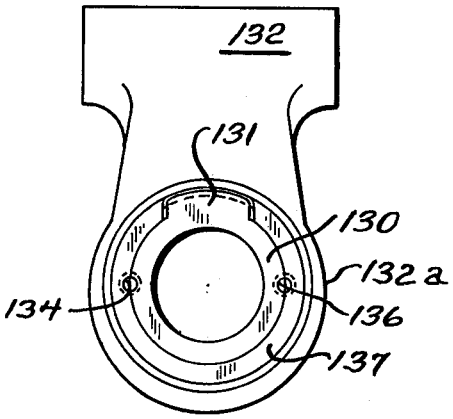
FIG. 13 is an end view of still another alternate configuration of a vise constructed in accordance with the principles of this invention.

FIG. 13 illustrates a modification of the vise structure shown in FIGS. 10, 11 and 12 and is substantially the same in all respects except that the movable body portion is secured to the vise by a hollow round tube member 130 having a restraint bar 131 formed at the upper portion thereof. Here the movable body portion is designated generally by reference numeral 132 and has a substantially round lower body portion 132*a* through which is formed a passage to receive the round tubular guide bar member. Here also the threaded passages 134 and 136, provided to receive locking bolts to hold in place an end cap 137, are formed partially in the movable body portion 32 and partially in the round tube 130.

Figure 14:
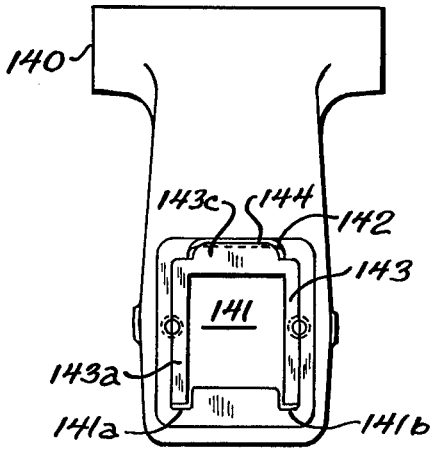
FIG. 14 is yet another alternate construction of a vise constructed in accordance with the principles of this invention.

FIG. 14 illustrates a further modification of a vise constructed in accordance with the general configuration illustrated in FIGS. 10, 11 and 12. Here a movable body portion 140 has a passage 141 and a recess 142 formed therein. In this instance the guide bar is formed by a channel member 143 having spaced apart flange portions 143*a* and 143*b* and a web portion 143*c*. Secured to the web portion is a restraint bar 144 and engages the recess 142 substantially in the same manner as set forth hereinabove. The threaded passages formed in the movable body portion have one-half thereof formed in the body portion and the other half thereof formed in the channel member. While a U-shaped, or C-shaped, channel member is shown, it will be understood that other channel shapes may be utilized. The lower portion of the passage 141 has depressions 141*a* and 141*b* to receive the free edges of the flanges 143*a* and 143*b*, respectively.

Figure 16:
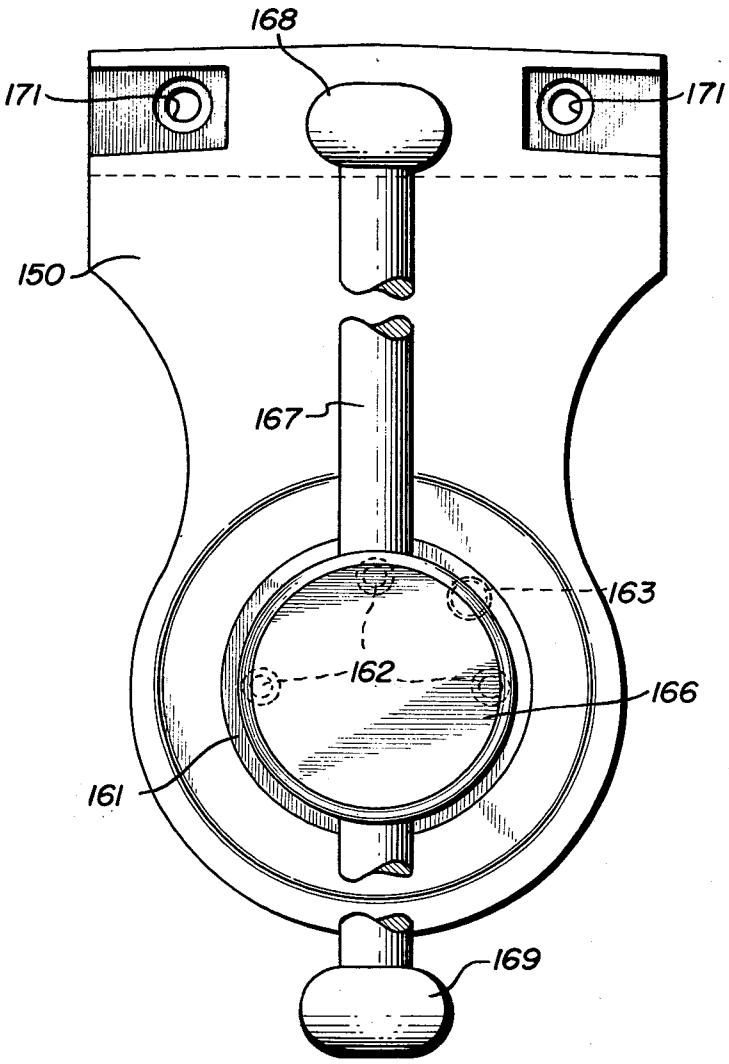
FIG. 16 is an end view of the chill bar and movable head shown in FIG. 15.
Figure 15:
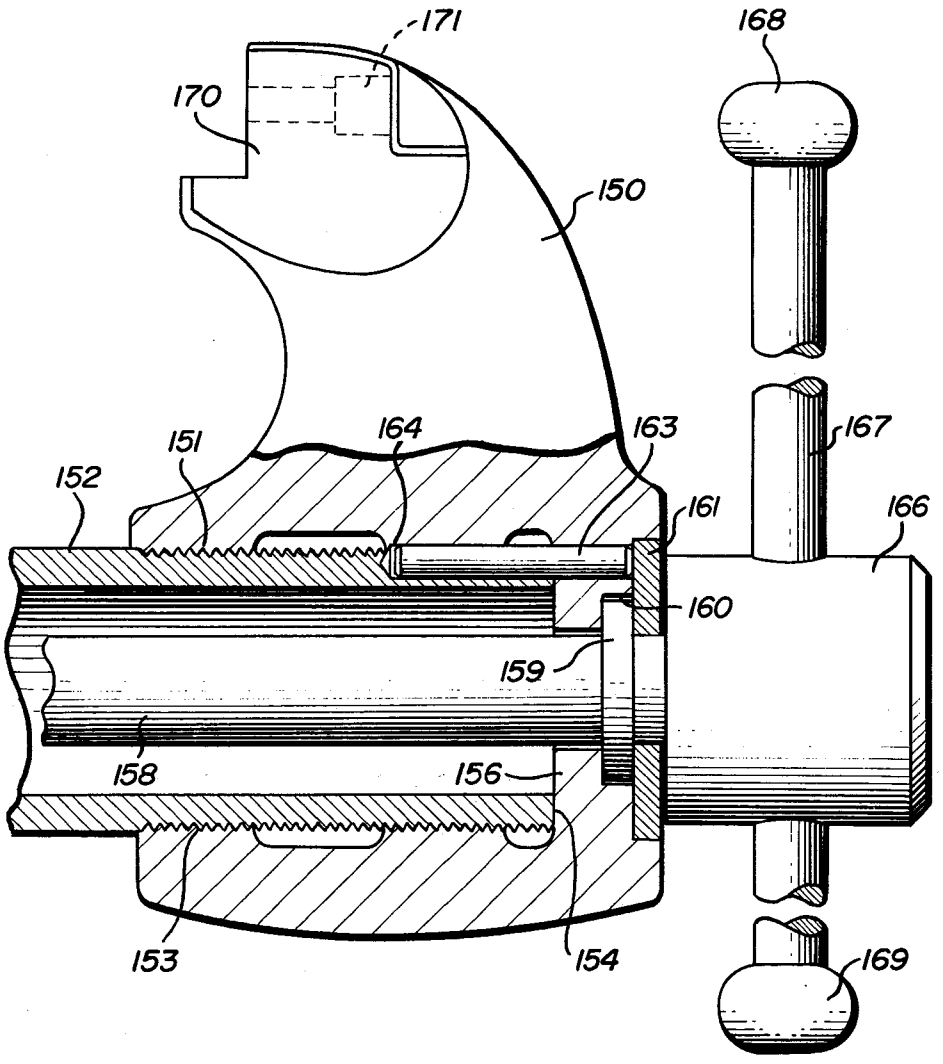
FIG. 15 is a side partially sectional view of a head and chill bar construction in accordance with another aspect of this invention.

Referring now to FIGS. 15 and 16, an alternate form of this invention is illustrated. Here, a movable vise head 150 has a threaded aperture 151 to receive the threaded end of a pipe 152 forming a chill bar. The theaded end of the pipe or chill bar is designated generally by reference numeral 153 and has an end portion 154 abutting the inner wall 156 of the movable vise head. A clamping screw shaft 158 has a flange 159 secured thereto or formed integral therewith. The flange 159 fits into a recess 160 in the movable vise head and is rotatably captured therein. The flange 159 is held in the recess 160 by means of an end cap 161 and a plurality of screws 162, as best seen in FIG. 16. To prevent the pipe 152 from rotating in the threaded aperture of the movable vise head, a lock pin 163 is inserted in an aperture 164 formed adjacent the periphery of the threads in the movable vise head and the threads on the pipe. This locks the two members together.

The clamping screw shaft 158 has a head end portion 166 through which extends a T-handle 167. The T-handle 167 preferably has enlarged ends 168 and 169 to prevent the handle from being removed from the head portion 166. While not forming a part of this invention, the movable head 150 includes a clamping insert 170 which is held in place by cap screws, 171, as is well known in the art. The head portion 170 may be of soft material such as brass and easily replaced by removing the screws 171.

Figure 17:
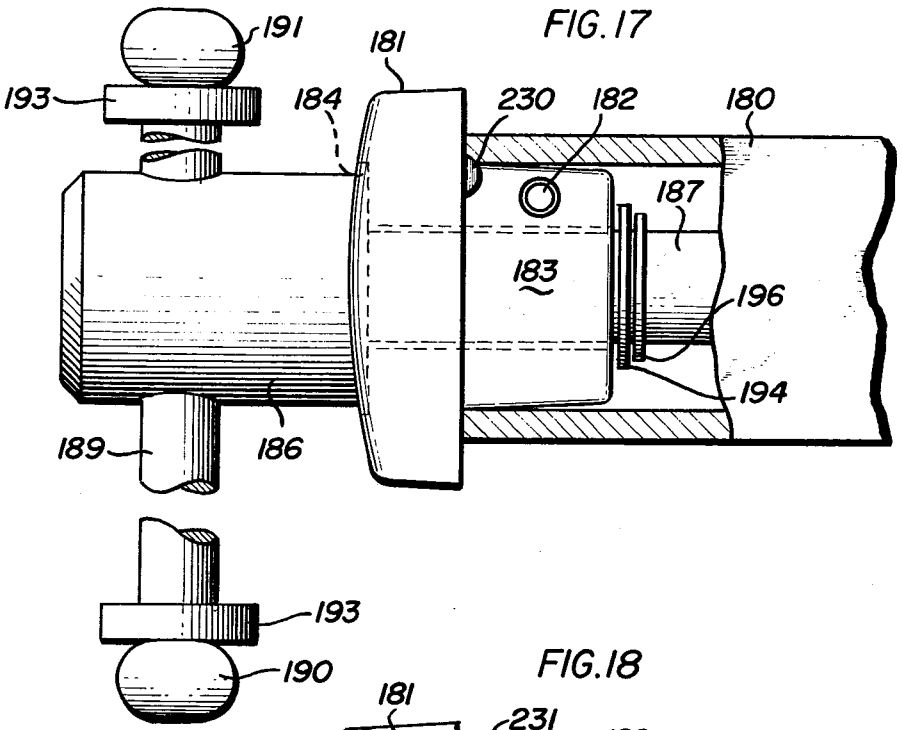
FIG. 17 is a partial fragmentary view of a chill bar and cap construction in accordance with the principles of this invention.
Figure 18:
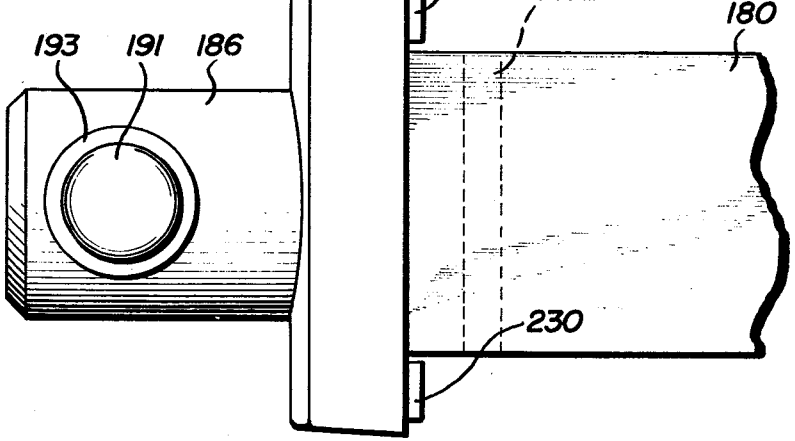
FIG. 18 is a top view of the chill bar and cap of FIG. 17.

Referring now to FIGS. 17 and 18 there is seen still another alternate embodiment of a chill bar construction in accordance with the principles of this invention. Here, a rectangular chill bar 180 is secured to an end cap 181 by means of a pin 182 passing through a boss portion 183 of the cap 181. The pin 182 may be a solid tapered pin or a roll pin and secures the rectangular chill bar 180 to the cap 181. The cap 181 has a recess 184 which receives a circular head portion 186 of a clamping screw shaft 187. Extending through the head portion 186 is a T-handle 189 which has enlarge ends 190 and 191 immediately adjacent to circular flanges 192 and 193, respectively. As seen in FIG. 17, the clamping screw shaft 173 includes a thrust washer 194 held in place by a clamping ring 196. The clamping ring 196 may be of the removable spring steel type which fits into a groove formed in the clamping screw shaft and which may be removed therefrom by forcing the clamping device against its own spring tension which holds it in place.

Figure 19:
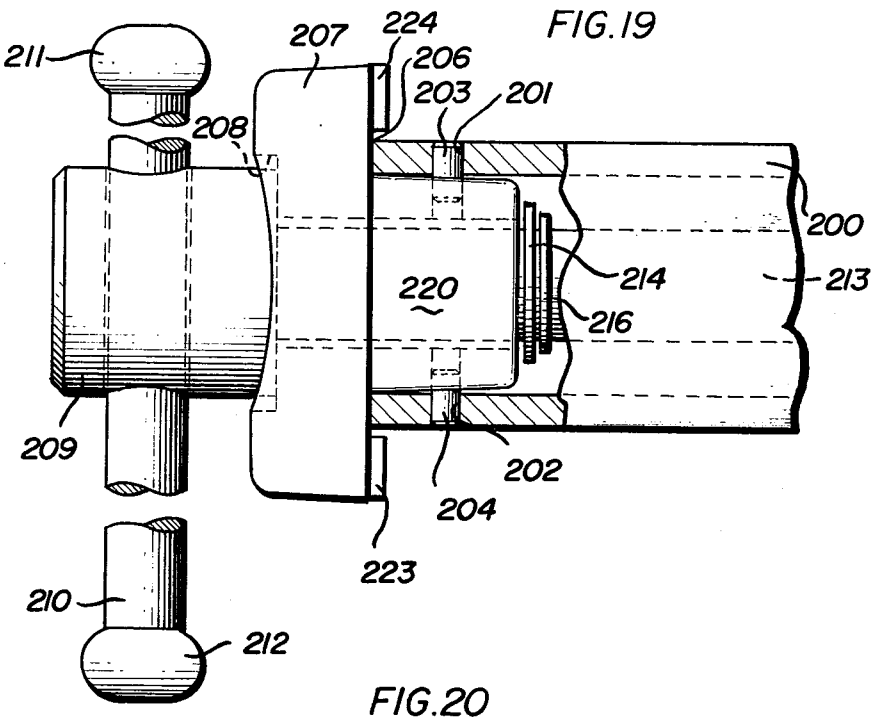
FIG. 19 is a partial fragmentary sectional view of still another form of chill bar and cap configuration in accordance with this invention.
Figure 20:
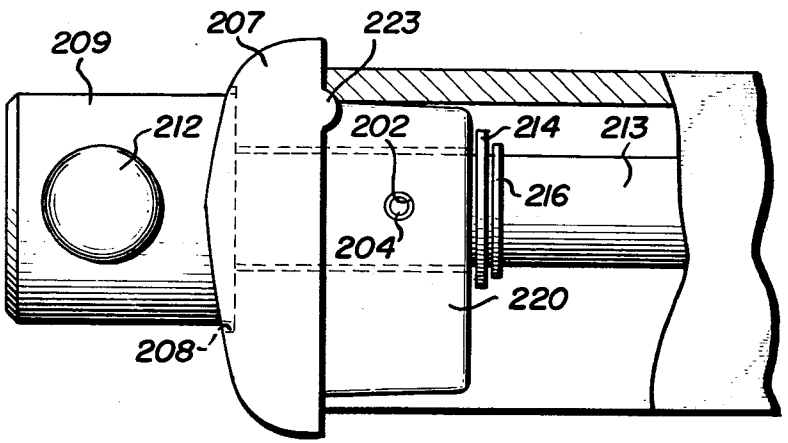
FIG. 20 is a top view of the chill bar construction shown in FIG. 19.

Referring now to FIGS. 19 and 20 still another alternate embodiment of the chill bar construction of this invention is illustrated. Here, a chill bar, preferably rectangular in configuration is designated generally by reference numeral 200 and includes radial apertures 201 and 202 to receive relatively short radial pins 203 and 204, respectively. The pins 203 and 204 may be solid tapered pins or roll pins as desired. The chill bar 200 abuts the face portion 206 of an end cap 207. The end cap is provided with a recess 208 which receives the circular head end portion 209 of the clamping screw shaft. Passing through the head portion 209 is a T-handle 210 which had enlarged end portions 211 and 212 preventing the handle from removal from the head portion 209. The clamping screw shaft is here illustrated by reference numeral 213 and includes a thrust washer 214 and a locking ring 216 similar to that illustrated in FIG. 17. The end cap 207 includes a boss portion 220 into which the pins 203 and 204 extend. The pins 203 and 204 therefore can be in diametral alignment with one another and in registry with the clamping screw shaft 213 as these pins do not extend completely through the unit. To maintain the end cap 207 in a relatively fixed position with regard to the movable clamping head bosses 223 and 224 are formed on opposite sides of the end cap and fit into correspondingly shaped rexesses, not seen on the drawings.

In like manner, the end cap 181, FIG. 17, includes a pair of bosses 230 and 231 which fit into correspondingly shaped recesses formed in the movable head of the vise structure.

What has been described is a novel vise construction which enables the cast formation of movable vise jaws free of the chill bar during the casting operation but which chill bar is easily added to the movable vise jaw during a relatively simple assembly procedure. The invention also is directed to an improved vise construction which enables the clamping screw to be substantially completely surrounded, thereby eliminating abrasion between the threads on the clamping screw and a threaded portion in the fixed body of the vise, thus reducing the wear therebetween.

While several specific embodiments of the invention have been illustrated herein, it will be understood that still other variations and modifications may be effected without departing from the spirit and scope of the novel concepts set forth in the following claims.

The invention is claimed as follows:

1. A vise construction comprising, a fixed body for mounting to a support surface, a slide passage formed in said fixed body slidably to receive guide bar means, a threaded passage formed in said fixed body to receive a clamping screw, a first jaw means formed on said fixed body, a movable body positioned adjacent said fixed body, a second jaw means formed on said movable body to cooperate with said first jaw means for holding an object, a clamping screw passing through said movable body and threadedly engaging said threaded passage for moving said second jaw means toward and away from said first jaw means, a recess formed in said movable body, slide bar means having one end portion thereof insertable into said recess, said slide bar means extending into said slide passage of said fixed body,, and locking means to secure said slide bar means to said movable body including a mechanical element interposed between said slide bar and said movable body to maintain said one end portion engaged with said recess.

2. The vise construction of claim 1 wherein said slide bar means is rectangular in the cross section.

3. The vise construction of claim 1 wherein said movable body is a cast member with said recess preformed therein and including nib means formed on one of the interior walls of said recess, said slide bar means having a groove means formed therein at said one end to receive said nib means, said nib and groove means providing a high force receiving connection between said movable body and said slide bar means, and said locking means includes means to maintain said nib means, and said groove means in engagement with one another.

4. The vise construction of claim 3 wherein said recess has a divergingly directed wall opposite said nib means, such that when said slide bar is inserted into said recess at an angle along said divergingly directed wall said one end will clear said nib means and subsequent pivotal movement of said slide bar will bring said groove means into engagement with said nib means.

5. The vise construction of claim 1 wherein said locking means includes a locking pin insertable into said recess at a passage immediately adjacent one wall thereof and said guide bar, said passage being accessable from the surface of said movable body from which said guide bar extends.

6. The vise construction of claim 1 wherein said locking means includes a setscrew through said movable body to lock said one end of said guide bar in position in said recess.

7. The vise construction of claim 1 wherein said locking means includes a locking pin insertable into said recess from the surface of said movable body opposite that of the surface from which said guide bar extends, said locking pin engaging said one end firmly to hold said guide bar in position in said recess.

8. The vise construction of claim 1 wherein said locking means includes a slanted end surface on said one end of said guide bar, and locking means extending through said movable body into said recess to engage said slanted surface to hold said guide bar in said recess.

9. The vise construction of claim 1 wherein said locking means includes epoxy resin filling the space within said recess not occupied by said one end firmly to hold said guide bar in position in said recess.

10. The vise construction of claim 1 wherein said slide passage and said threaded passage are in longitudinal registry with one another.

11. The vise construction of claim 1 further including a restraint bar secured to and extending from said slide bar means, said restraint bar forming said one end portion, said second jaw means having a gripping surface facing said second jaw means, and said recess being formed in said movable body on the side thereof opposite said gripping surface.

12. The vise construction of claim 11 wherein said locking means includes an end cap secured to said opposite side of said movable body, said end cap overlying said slide bar means and said restraint bar, and screw means for holding said end cap in position to said movable body.

13. The vise construction of claim 12 wherein said screw means includes at least one threaded aperture extending parallel with said slide bar means and having one portion of the threaded aperture formed in said slide bar means and another portion of the threaded aperture formed in said movable body.

14. A vise construction comprising, a fixed body for mounting to a support surface, a movable body positioned adjacent said fixed body and movable relative thereto for opening to receive a workpiece and for closing upon the workpiece for holding it in place, a slide passage formed in said fixed body, a guide bar, means securing said guide bar to said movable body including a mechanical element interposed between said guide bar and said movable body, said guide bar extending toward said fixed body to slidably traverse within said slide passage during movement of said movable body, and a clamping screw rotatably secured to said movable body and threadedly engaging thred means formed on said fixed body for causing movement of said movable body as a result of rotation of said clamping screw, said clamping screw having the longitudinal axis thereof in registry with said slide passage and positioned between at least two side wall portions of said guide bar.

15. The vise construction as set forth in claim 14 wherein said guide bar is a hollow round tube and said clamping screw passes therethrough.

16. The vise construction as set forth in claim 15 wherein said hollow round tube is threaded and said movable body is provided with corresponding threads to receive said hollow round tube.

17. The vise construction as set forth in claim 16 further including an aperture formed along the periphery of the threads in said hollow round tube and said movable body, and wherein said mechanical element comprises pin means inserted into said aperture to lock the said hollow round tube to said movable body thereby preventing relative rotation of said hollow round tube with respect to said movable body.

18. The vise construction as set forth in claim 14 wherein said guide bar is a hollow square tube and said clamping screw passes therethrough.

19. The vise construction as set forth in claim 18 wherein said hollow square tube fits over a boss associated with said movable body, and a pair of diametrically opposed pins extend into said hollow square tube on opposite sides thereof and into said boss, said pins being in registry with said clamping screw extending therefrom.

20. The vise construction as set forth in claim 18 wherein said hollow square tube has the end thereof secured to a boss associated with said movable body, and an aperture extending through said hollow square tube and said boss, and a pin extending completely through said aperture, said pin being displaced from said clamping screw.

21. The vise construction as set forth in claim 14 wherein said guide bar is a channel member having a pair of spaced apart flange portions and a web portion connecting said flange portions together and wherein said clamping screw passes between said flange portions.

22. The vise construction as set forth in claim 21 wherein said channel member is mounted over a boss associated with said movable body, and apertures extend through said channel member and into said boss and pins extending through said apertures for locking said channel member to said boss.

23. The vise construction as set forth in claim 21 wherein said channel member is secured to a boss associated with said movable body, an aperture extending completely through said channel member and said boss, and a pin extending through said aperture to lock said channel member to said boss associated with said movable body.

* * * * *

UNITED STATES PATENT AND TRADEMARK OFFICE

CERTIFICATE OF CORRECTION

PATENT NO. : 4,040,613

DATED : August 9, 1977

INVENTOR(S) : Raymond H. Kartasuk, Walter R. Smierciak and Edward A. Hlinka

It is certified that error appears in the above-identified patent and that said Letters Patent are hereby corrected as shown below:

Column 5, line 35, "65" should be --64--;

Column 6, line 9, "12, 12 and 14" should be --12, 13 and 14--;

Column 6, line 12, "he fixed body" should be --the fixed body--;

Column 6, line 53, "bering" should be --bearing--;

Column 6, line 68, "32" should be --132--;

Column 10, line 10, "thred" should be --thread--

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*